US007207070B1

(12) United States Patent
Swarez-Ballesteros

(10) Patent No.: US 7,207,070 B1
(45) Date of Patent: Apr. 24, 2007

(54) APPARATUS AND METHOD FOR BREAST FEEDING

(76) Inventor: Eva R. Swarez-Ballesteros, 184 Madrona St., C.V., CA (US) 91910

( * ) Notice: Subject to any disclaimer, the term of this patent is extended or adjusted under 35 U.S.C. 154(b) by 0 days.

(21) Appl. No.: 11/373,377

(22) Filed: Mar. 10, 2006

(51) Int. Cl.
*A41D 1/20* (2006.01)
*A41D 3/08* (2006.01)

(52) U.S. Cl. ..... 2/104; 2/51; 2/88

(58) Field of Classification Search ..... 2/104, 2/105, 106, 114, 46, 51, 50, 52, 49.1–49.4, 2/69, 69.5, 115, 88
See application file for complete search history.

(56) References Cited

U.S. PATENT DOCUMENTS 277,178 A * 5/1883 Webb ..... 2/51
1,524,457 A * 1/1925 Selander ..... 2/51
2,379,722 A * 7/1945 Kase ..... 2/50
4,566,136 A * 1/1986 Echols ..... 2/104
5,469,582 A * 11/1995 Livingston ..... 2/104
5,479,662 A * 1/1996 Runco ..... 2/104

* cited by examiner

*Primary Examiner*—Gloria M. Hale
(74) *Attorney, Agent, or Firm*—Dalina Law Group, P.C.

(57) ABSTRACT

A nursing garment and method enabling women to nurse a baby in public by covering the mothers. Maintains the breastfeeding relationship by allowing breastfeeding to occur anywhere at anytime. Provides a nursing mother a true sense of privacy and modesty, and provides a mother the added security that most nursing garments or blankets do not. The nursing garment is formed by lined lightweight material and is designed to cover the mother's upper torso, partial back and the nursing infant. The curtain is attached around the neck of the mother by a semi-rigid annular hoop. A layer of material lies across the front panel forming a valance or curtain for added privacy. Added inside the nursing curtain is a pocket for the nursing mother to place nursing paraphernalia and attached to the pocket is a small sized sanitary cloth for the nursing infant and mother.

9 Claims, 4 Drawing Sheets

APPARATUS AND METHOD FOR BREAST FEEDING

BACKGROUND OF THE INVENTION

1. Field of the Invention

Embodiments of the invention described herein pertain to the field of garments. More particularly, but not by way of limitation, one or more embodiments of the invention enable a secured nursing garment or curtain for use by mothers who wish to nurse their infants modestly and comfortably in public and in private settings.

2. Description of the Related Art

Several different nursing devices have been designed to help nursing mothers maintain a modest and private nursing experience in public. The following nursing garments U.S. Pat. No. 4,468,816 issued to Kaufer Sep. 4, 1984, and U.S. Pat. No. 4,964,172 issued to Bollard Oct. 23, 1990, show a similar design but they do not offer private, secure coverage, which is a problem for a nursing mother. Both Kaufer and Bollard employ arm loops to hold the nursing garment in place. As the nursing infant ages into a toddler his curiosity increases leading to possibly lifting the garment or pulling the garment to the side leaving the mother's breast exposed. The nursing garments of Kaufer and Bollard also have to be secured in place by placing pressure using the body weight of a nursing mother against the back portion of the nursing garments to keep the nursing garments from falling off the shoulder. This means that the mother must always sit against an object and this limits where the nursing mother can use the garment. The nursing devices of Kaufer and Bollard also are also inconvenient if the nursing mother drapes the garment over her body, since she may have to use the side of her head or chin to keep the garment in place while she gets her breast ready to nurse, potentially leading to exposure, frustration and embarrassment.

While other related art uses a neck device for attachment and security, these devices also lack side security and privacy. U.S. Pat. No. 4,797,953, issued to Dameron on Jan. 17, 1989, U.S. Pat. No. 4,924,528, issued to Trombetti-Dickens on May 15, 1990, U.S. Pat. No. 5,090,059 issued to Kahl on Feb. 25, 1992, and U.S. Pat. No. 6,581,209 issued to Bramhan on Jun. 24, 2003, all have a neck band made of material therefore causing an inconvenience for a mother who desires full privacy. The nursing mother who nurses from infancy to toddler age faces the increased possibility of pulling or pushing open on the sides or the flaps of the apparatus. Another possibility is that the infant may begin to tug on the device causing wear on the material attachments. The neckbands formed of material also add a dilemma in viewing the nursing infant. The nursing garments of these inventions tend to have neckbands made of material to generally fit every various sized mother therefore causing a problem in the way that the neckband hangs on the mother. The neckband may lay lower on mothers then on others causing an exposure problem for those mothers and when viewing the nursing infant the hanging material and neckband may expose much more then the modest nursing mother may intend for. For those nursing garments that must tie, when the nursing infant is demanding, due to hunger, the mother must tie the nursing garment around her neck most likely to tie around the neck area snugly adding an inconvenience to view the infant through the top portion of the garment leading to an uncovering of the side panels, exposing the nursing infant and nursing mother's breast region.

U.S. Pat. No. 4,716,597 for Nursing Garment issued Jan. 5, 1988 to Karen M. Griggs. Griggs Nursing garment is a poncho intended to fit over the mother's outerwear attached by means of a hoop anchored to the body of material covering the mother's upper body and the nursing infant. Griggs nursing garment gives little airflow to the nursing infant or toddler due to full closed coverage. This garment also is very inconvenient for mothers who need to uncover quickly and conveniently due to the garments fit and the way the garment is put on or taken off the mother. The size of the hoop also causes concern for mothers of different size. With the design of the poncho, the hoop must be large enough to fit all mothers of varying size. The hoop may fit one mother properly while it may fit a smaller framed mother larger therefore causing sagging in the front portion of the garment leading to exposure of the infant and mother or later lead to pulling on the hoop by the infant. The nursing poncho also is inconvenient for nursing mothers who wish to maintain their hairstyle because of the way to place the garment on and off overhead.

U.S. Pat. No. 5,479,662 for Privacy Covering For Nursing Mothers issued Jan. 2, 1996 to Teri Runco. Runco's Privacy covering for nursing mothers is intended to fit over the mother's outerwear, in the front portion of the nursing mothers upper torso, attached by means of a material band. The upper portion of the garment is lined by a piece of flexible material, which molds into an outwardly bowed horizontal direction giving the mother access to view her nursing infant. Runco's nursing garment makes it very accessible in public and private settings for the person walking by or above the mother who is sitting down to view the nursing infant and mother. While the emphasis is to nurse modestly, this nursing garment does not eliminate exposure. Runco's nursing garment also is inconvenient in that it does not provide security partially around the nursing mothers back; the nursing garment drapes the frontal portion of the mother leaving the side panels unsecured and where potential exposure is possible.

For at least the limitations described above there is a need for a nursing garment for use by mothers who wish to nurse their infants modestly and comfortably in public and in private settings.

BRIEF SUMMARY OF THE INVENTION

One or more embodiments of the invention enable a nursing garment for use by mothers who wish to nurse their infants modestly and comfortably in public and in private settings. While breastfeeding is on the rise, many mothers who decide to nurse face the decision of what to do in public. Therefore the disruption of the nursing relationship may result in supplementation and possibly weaning. The nursing garment of this invention provides the nursing mother confidence while she attends to her infant in providing a modest and comfortable experience in her own private and secured setting. Whether the nursing mother is with her infant or without she may also pump milk modestly while utilizing embodiments of the nursing device detailed herein to maintain her nursing relationship with her infant.

The nursing garment of this invention provides a privacy covering for nursing mothers yet provides the mother a convenient method of detachment and also partially covers the nursing mothers back adding more security and freedom to walk. In addition, the nursing mother may choose to sit against an object for more security or choose not to sit against anything at all. The garment of this invention also provides the nursing mother the choice of removal by either overhead or by detachment devices. The nursing garment gives privacy with lined light weight material which drapes evenly down to the mother's hip area and an extra piece of material forming a valance or curtain along the upper portion of the lined material. The nursing garments material is formed around the neck by a plastic semi-rigid hoop, possibly using other material for the hoop such as metal, etc. The nursing garment opens at the back of the neck area and goes down the mother's back to the hip area giving the mother the choice to turn the garment around for partial privacy. In addition, the opening or slit allows for airflow to reach the baby. The nursing garment also contains a pocket for mother's nursing paraphernalia and attached sanitary cloth for nursing accidents caused by infant and mother.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION

A nursing garment for use by mothers who wish to nurse their infants modestly and comfortably in public and in private settings will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
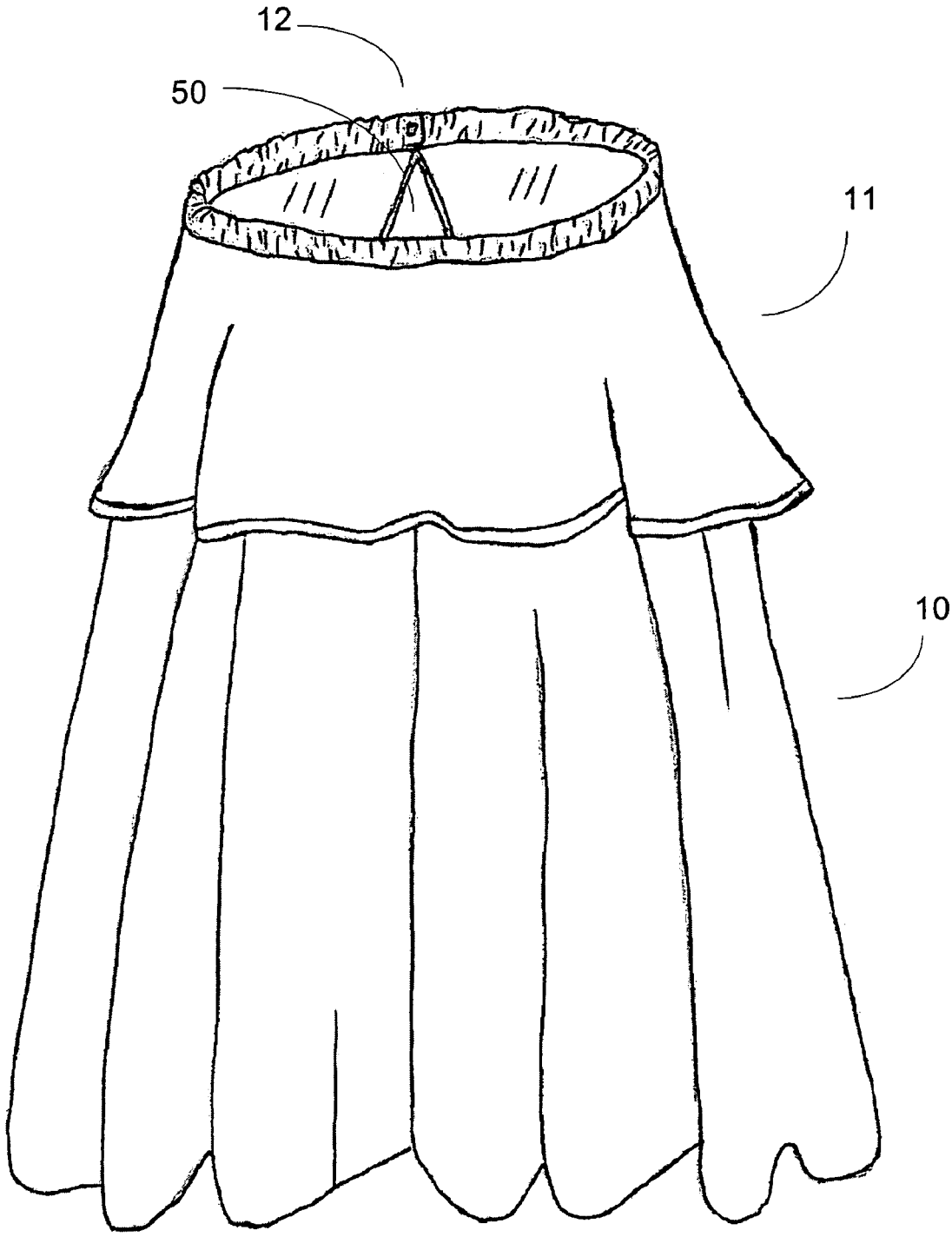
FIG. 1 shows a frontal view of an embodiment of the invention.
Figure 2:
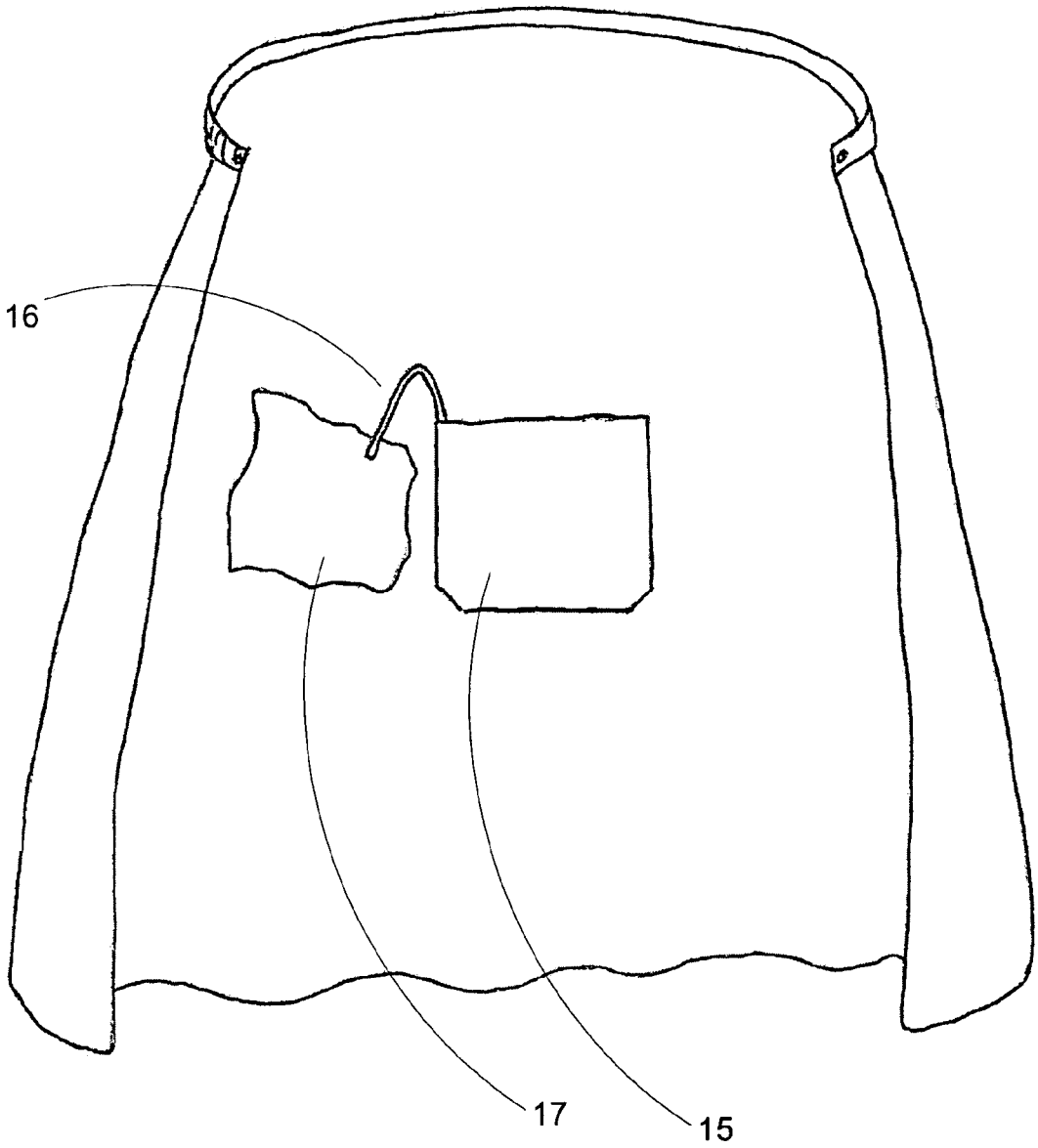
FIG. 2 shows a opened back and interior view of an embodiment of the invention.
Figure 3:
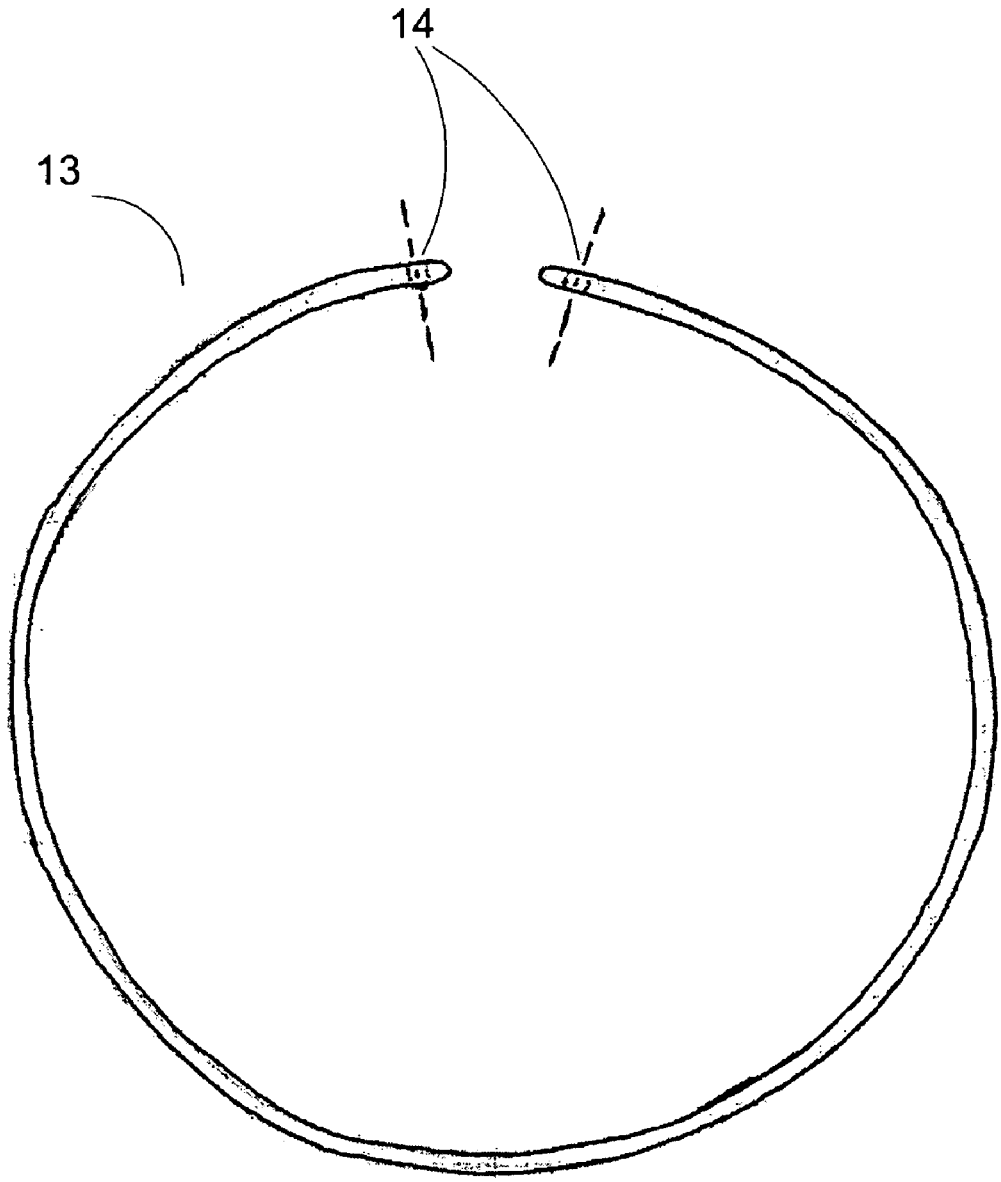
FIG. 3 shows a semi rigid annular neck ring or hoop broken away from an embodiment of the invention.

FIG. 1 shows a frontal view of an embodiment of the invention. Nursing garment 10 has a cloth body made with lined lightweight material, layered with curtain/valance 11 and secured using closure devices such as snap closures 12. Valance 11 functions as a secondary covering which further hides activity happening behind valance 11 and nursing garment 10. When snap closures 12 are in the closed position, nursing garment 10 covers the nursing mother's upper torso. As illustrated in FIGS. 1 and 2, snap closures 12 are attached to each material end of nursing garment 10. Inside the top material is a semi rigid hoop 13 securely sewn inside the material of nursing garment through holes at the ends of a circular tube formed at the top of the nursing garmet as shown in FIG. 3. One method of forming the circular tube is to roll the top end of nursing garment 10 down and sew a seam parallel to the end of the material. As hoop 13 is inserted in to the tube, the topmost material in nursing garment 10 bunches up and tightens about hoop 13. Snap closures 12 are used to close the device about a nursing mother's neck. The rear portion of nursing garment 10 allows for slit 50 to introduce airflow from the rear portion of the nursing garment. In one or more embodiments of the invention, the apparatus is 34 inches tall. In other embodiments of the invention, the apparatus may be shorter or taller depending on the size of the mother utilizing the device. One or more embodiments of the invention are lined with a material that is absorbent to prevent liquid from escaping. The cloth body and valance may be obtained by purchasing the material or utilizing material given to an entity that is manufacturing an embodiment of the invention. Any type of material may be obtained and utilized in an embodiment of the invention, including absorbent material for example.

FIG. 2 is the interior view of the nursing garment with nursing paraphernalia pocket 15, attachment device 16 formed of material that holds lined sanitary burp cloth 17 so that it remains attached to nursing garment 10. Burp cloth 17 may couple to attachment device 16 using a snap or VELCRO®, (generically known as a hook and loop fastener), or any other method of attachment. When accessing burp cloth 17, the mother reaches inside of nursing paraphernalia pocket 15 and removes burp cloth 17. If the mother drops burp cloth 17, the burp cloth does not fall on the floor since burp cloth 17 is attached to nursing garment 10 via attachment device 16. The nursing mother simply searches for nursing paraphernalia pocket 15 and traces attachment device 16 to burp cloth 17 that has fallen. The nursing mother does not have to search for burp cloth 17 visually in this case. Valance 11 acts to provide another level of drape coverage to further hide the movement occurring beneath valance 11 during nursing or use of burp cloth 17.

FIG. 3 shows a semi rigid annular neck ring or hoop broken away from an embodiment of the invention. Semi rigid hoop 13 may in one embodiment be 8 inches in diameter. In other embodiments semi-rigid hoop 13 may be larger or smaller. Semi-rigid hoop 13 is made from a material that is bendable yet flexes back to its original shape in order to allow a nursing mother to spread the ends of semi-rigid hoop 13 wide enough to allow for the nursing mother's neck to enter the inner portion of semi-rigid hoop 13. Once the mother's neck is inside semi-rigid hoop 13, the hoop can be released in order to bring the ends close enough together to couple the ends. The ends may comprise holes which allow for the material of nursing garment 10 to be fixedly attached to the ends of semi-rigid hoop 13. This for example provides for a stationary position of semi-rigid hoop 13 when sewn inside the tube at the top portion of nursing garment 10. In one or more embodiments of the invention, semi-rigid hoop 13 is plastic and a eighth to a quarter of an inch thick. Any thickness of semi-rigid annular hoop 13 may be utilized as long as semi-rigid annular hoop may be opened by a nursing mother and return to a position that is closed enough for the ends to be coupled together, for example by snaps.

Figure 4:
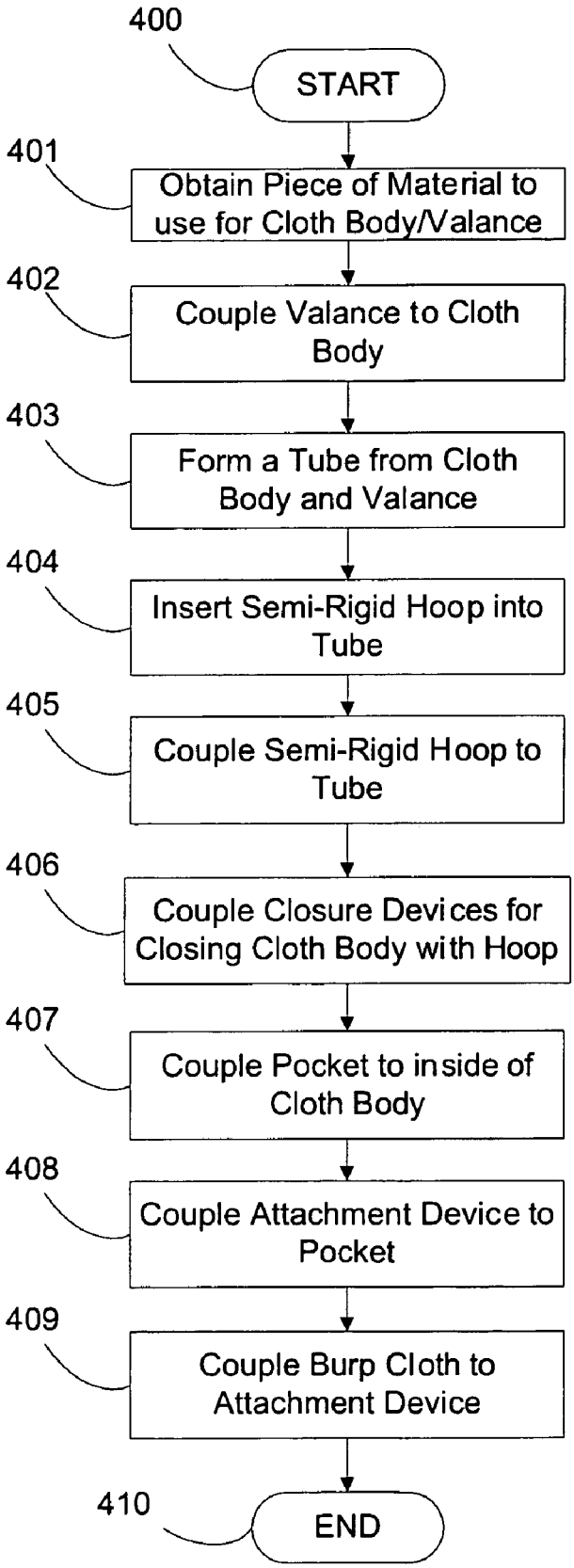
FIG. 4 shows a method for manufacturing an embodiment of the invention.

A method for manufacturing a nursing garment is shown in FIG. 4. The process begins at 400 and starts by obtaining a piece of material to be used as a cloth body configured to cover a nursing mother's torso at 401. Coupling a valance with the cloth body occurs at 402 wherein the valance is configured to further conceal a nursing mother and nursing activities that occur behind the valance. Forming a tube from the cloth body and the valance occurs at 403. Inserting a semi-rigid hoop into the tube wherein the semi-rigid hoop has a first end and a second end wherein the first end and the second end have openings that are configured to be coupled with the cloth body occurs at 404. Coupling the first end and the second end of the semi-rigid hoop to the cloth body within the tube occurs at 405. Coupling a first closure device and a second closure device, for example snaps, with two corners of the cloth body wherein the first closure device and the second closure device are configured to be coupled with one another in order to close an upper portion of the cloth body around the neck of the nursing mother occurs at 406. Coupling a pocket on an interior side of the cloth body facing a nursing mother's torso wherein the pocket is configured to hold articles of a nursing nature occurs at 407. Coupling an attachment device coupled with the pocket occurs at 408. Coupling a burp cloth with the attachment device wherein the burp cloth is configured to be placed inside of the pocket and wherein the burp cloth is utilized to clean up any unwanted mess made by an infant or the nursing mother while the infant is breastfed occurs at 409 and the process finishes at 410.

While the invention herein disclosed has been described by means of specific embodiments and applications thereof, numerous modifications and variations could be made thereto by those skilled in the art without departing from the scope of the invention set forth in the claims.

What is claimed is:

1. A nursing garment for covering the upper torso and partial back of a mother's body and an infant during breast-feeding comprising:

a cloth body configured to cover a nursing mother's torso wherein said cloth body comprises a slit positioned on the rear of said cloth body that runs in a vertical axis;

a valance coupled with said cloth body configured to further conceal a nursing mother and nursing activities that occur behind said valance;

a semi-rigid hoop having a first end and a second end wherein said first end and said second end have openings that are coupled with said cloth body after said semi-rigid hoop is inserted within a tube formed in said cloth body;

a first closure device and a second closure device coupled with two corners of said cloth body wherein said first closure device and said second closure device are coupled with one another in order to close an upper portion of said cloth body around the neck of said nursing mother;

a pocket coupled to an interior side of said cloth body facing a nursing mother's torso wherein said pocket is configured to hold articles of a nursing nature;

an attachment device coupled with said pocket; and, a burp cloth coupled with said attachment device wherein said burp cloth is configured to be placed inside of the said pocket and wherein said burp cloth is utilized to clean up any unwanted mess made by an infant or said nursing mother while said infant is breastfed.

2. The nursing garment of claim 1 wherein said cloth body is lined with a second material.

3. The nursing garment of claim 1 wherein said cloth body is an absorbent material.

4. The nursing garment of claim 1 wherein said semi-rigid hoop is plastic.

5. The nursing garment of claim 1 wherein said first closure device and said second closure device are snaps.

6. The nursing garment of claim 1 wherein said attachment device is a string having a hook and loop fastener end.

7. The nursing garment of claim 1 wherein said burp cloth comprises a hook and loop fastener portion that couples with said attachment device that comprises a hook and loop fastener end.

8. The nursing garment of claim 1 wherein said burp cloth is configured to be detached from said attachment device and washed separately from said cloth body.

9. A method for manufacturing a nursing garment for covering the upper torso and partial back of a mother's body and an infant during breast-feeding comprising:

obtaining a piece of material to be used as a cloth body configured to cover a nursing mother's torso;

coupling a valance with said cloth body wherein said valance is configured to further conceal a nursing mother and nursing activities that occur behind said valance;

forming a tube from said cloth body and said valance;

inserting a semi-rigid hoop into said tube wherein said semi-rigid hoop comprises a first end and a second end wherein said first end and said second end have openings that are configured to be coupled with said cloth body coupling said first end and said second end of said semi-rigid hoop to said cloth body within said tube;

coupling a first closure device and a second closure device with two corners of said cloth body wherein said first closure device and said second closure device are configured to be coupled with one another in order to close an upper portion of said cloth body around the neck of said nursing mother;

coupling a pocket on an interior side of said cloth body facing a nursing mother's torso wherein said pocket is configured to hold articles of a nursing nature;

coupling an attachment device coupled with said pocket; and, coupling a burp cloth with said attachment device wherein said burp cloth is configured to be placed inside of the said pocket and wherein said burp cloth is utilized to clean up any unwanted mess made by an infant or said nursing mother while said infant is breastfed.

* * * * *